US006503158B2

(12) United States Patent
Murphy et al.

(10) Patent No.: US 6,503,158 B2
(45) Date of Patent: Jan. 7, 2003

(54) DUAL NON-CIRCULAR DIMPLE FOR GOLF BALLS

(75) Inventors: Daniel Murphy, Chicopee, MA (US); Mark L. Binette, Ludlow, MA (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 0 days.

(21) Appl. No.: 09/796,760

(22) Filed: Mar. 1, 2001

(65) Prior Publication Data

US 2002/0123395 A1 Sep. 5, 2002

(51) Int. Cl.[7] ..... A63B 37/14
(52) U.S. Cl. ..... 473/384
(58) Field of Search ..... 473/378–383, 473/384

(56) References Cited

U.S. PATENT DOCUMENTS

| | | | | | |
|---|---|---|---|---|---|
| 922,773 | A | * | 5/1909 | Kempshall | 473/383 |
| 1,666,699 | A | * | 4/1928 | Hagen | 473/383 |
| 1,716,435 | A | * | 6/1929 | Fotheringham | 473/383 |
| 2,002,726 | A | * | 5/1935 | Young | 473/383 |
| 4,729,861 | A | | 3/1988 | Lynch et al. | |
| 4,813,677 | A | | 3/1989 | Oka et al. | |
| 4,830,378 | A | | 5/1989 | Aoyama | |
| 4,869,512 | A | * | 9/1989 | Nomura et al. | 473/383 |
| 4,877,252 | A | * | 10/1989 | Shaw | 473/383 |
| 4,936,587 | A | | 6/1990 | Lynch et al. | |
| 5,080,367 | A | | 1/1992 | Lynch et al. | |
| 5,090,705 | A | | 2/1992 | Oka et al. | |
| 5,143,377 | A | * | 9/1992 | Oka et al. | 473/383 |
| 5,338,039 | A | | 8/1994 | Oka et al. | |
| 5,377,989 | A | * | 1/1995 | Machin | 473/383 |
| 5,470,076 | A | * | 11/1995 | Cadorniga | 473/383 |
| 5,503,398 | A | | 4/1996 | Lu | |
| 5,688,194 | A | * | 11/1997 | Stiefel et al. | 473/383 |
| 5,782,702 | A | | 7/1998 | Yamagishi et al. | |
| 5,890,975 | A | * | 4/1999 | Stiefel | 473/384 |
| 6,019,688 | A | * | 2/2000 | Sullivan | 473/383 |
| 6,059,671 | A | | 5/2000 | Asakura | |
| 6,162,136 | A | * | 10/2000 | Aoyama | 473/383 |
| 6,206,792 | B1 | * | 3/2001 | Tavares et al. | 473/378 |
| 6,315,685 | B1 | * | 11/2001 | Tavares et al. | 473/378 |
| 6,315,686 | B1 | * | 11/2001 | Barfield | 473/383 |

* cited by examiner

*Primary Examiner*—Steven Wong
*Assistant Examiner*—Raeann Gorden

(57) ABSTRACT

A combination dimple pattern on the surface of a golf ball is characterized by both non-circular and non-circular compound dimples. The compound dimples include a first non-circular dimple portion and a second non-circular dimple portion arranged in a bottom surface of the first portion, with the second dimple portion having a depth greater than the depth of the first circular portion. The combination of compound and circular dimples on the surface of the ball improves the aerodynamic efficiency of the ball for more control of lift and drag of a spinning golf ball during flight.

14 Claims, 2 Drawing Sheets

DUAL NON-CIRCULAR DIMPLE FOR GOLF BALLS

BACKGROUND OF THE INVENTION

The present invention relates to a new dimple combination pattern on a golf ball surface which improves the flight characteristics of the ball.

According to the United States Golf Association (U.S.G.A.) rules, a golf ball may not have a weight in excess of 1.620 ounces or a diameter smaller than 1.680 inches. The initial velocity of balls conforming to U.S.G.A. regulations may not exceed 250 feet per second with a maximum tolerance of 2%. Initial velocity is measured on a standard machine kept by the U.S.G.A. A projection on a wheel rotating at a defined speed hits the test ball, and the length of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a tolerance of plus 4% and a 2% tolerance for test error.

These specifications limit how far a struck golf ball will travel in several ways. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and, thus, a lower drag when traveling through the air. Increasing initial velocity increases the distance the ball will travel.

Drag on a golf ball is also reduced by forming a plurality of dimples, often circular, in the outer surface of the ball. The dimples serve to reduce the pressure differential between the front and rear of the ball as it travels through the air.

BRIEF DESCRIPTION OF THE PRIOR ART

Numerous dimple configurations for use on golf balls are well-known in the patented prior art, including contoured dimples. For example, the White U.S. Pat. No. 1,418,220 discloses a golf ball having rectangular dimples formed in the surface thereof. Each rectangular dimple includes in its bottom surface a small circular recess. Such a dimple configuration prolongs the life of the golf ball as well as improves the flight of the ball when struck. Golf balls having dimples with different configurations are also known in the patented prior art as shown by the U.S. patents to Nomura et al U.S. Pat No. 4,869,512 and Oka et al U.S. Pat. Nos. 5,143,377, 5,174,578, and 5,338,039. U.S. Pat. No. 5,174,578 for example discloses a golf ball having both circular and polygonal dimples. While the dimple combinations of the prior art increase the turbulence of the air flow across the surface of the golf ball during flight, there is still room for improvement in this regard as a function of dimple designs.

Accordingly, an improved compound dimple was developed as disclosed in the Aoyama U.S. Pat. No. 6,162,136. The compound dimple includes a central depression, an annular depression concentrically surrounding the central depression, and a land ring arranged between the central and annular depressions. In addition, the Kennedy et al U.S. patent application Ser. No. 09/730,868 (which is assigned to the assignee of the present invention) discloses a golf ball with compound and circular dimples. The compound dimples include first and second circular dimple portions with the second dimple portion being arranged in the bottom of the first portion and having a diameter less than that of the first dimple portion.

The present invention was developed in order to improve the aerodynamic efficiency of the dimples for more control of lift and drag of a spinning golf ball during flight.

SUMMARY OF THE INVENTION

Accordingly, it is a primary object of the present invention to provide a compound dimple for a golf ball including a first non-circular dimple portion having a first depth and a second non-circular dimple portion at least partially arranged in a surface of the first portion, the second portion having a second depth greater than the first depth.

According to another object of the invention, the second portion is completely arranged within the first portion and has a configuration corresponding to the first portion, with the first and second portions having a common major axis.

According to a further object of the invention, a line along a bottom of the first dimple portion between a surface of the golf ball and a deepest point of the first portion is a straight line.

It is another object of the present invention to provide a golf ball having a spherical surface including a plurality of dimples arranged in the surface. A first group of dimples in the ball surface are compound dimples, each of which includes a first non-circular dimple portion having a first depth and a second non-circular dimple portion at least partially arranged in a surface of the first circular dimple portion, the second portion having a second depth greater than the first depth. A second group of non-circular dimples may also be provided in the golf ball surface.

The compound non-circular dimples are formed by drilling into a spherical surface with a first milling cutter having a first radius during a first milling step, displacing either the first milling cutter or the surface in a first direction during the first milling step to form an elongated first dimple portion, milling into the first dimple portion to a second depth greater than the first depth with a second milling cutter having a second radius less than the first radius during a second milling step, and displacing either the surface or the second milling cutter in the first direction during the second milling step to form an elongated second dimple portion.

The displacement of the second milling cutter during the second milling step can be limited to retain the second dimple portion within the first dimple portion, or the second milling cutter can be displaced relative to the spherical surface so that a portion of the second dimple portion extends beyond the first dimple portion.

BRIEF DESCRIPTION OF THE FIGURES

These and other objects according to the invention will become apparent from a study of the following specification when viewed in the light of the accompanying drawing, in which.

DETAILED DESCRIPTION

Figure 1:
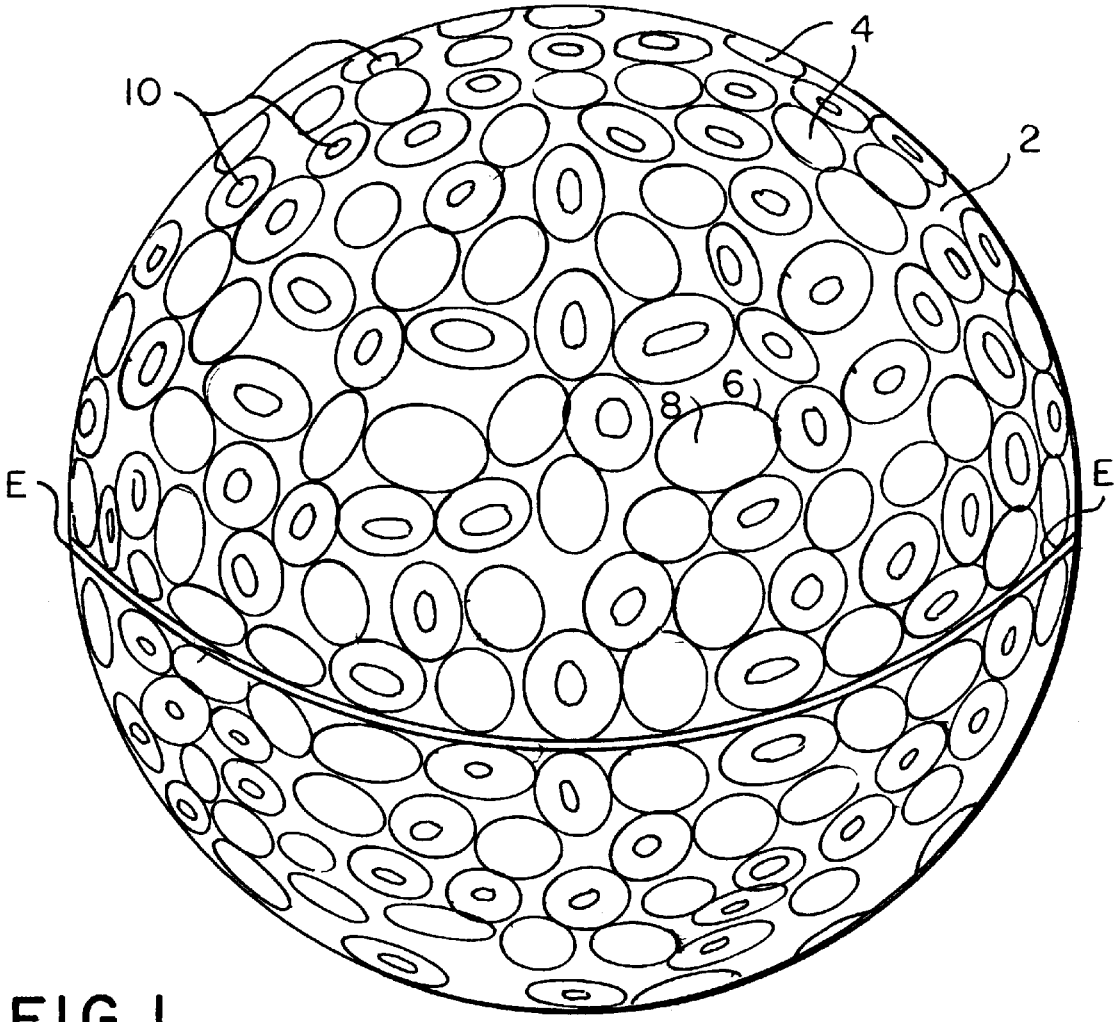
FIG. 1 is plan view of a golf ball including a plurality of compound non-circular and non-circular dimples according to the invention.

In FIG. 1, there is shown a golf ball 2 having a spherical surface which is divided into two hemispheres by an equator E. The surface contains a plurality of non-circular dimples 4 as defined where the dimple intersects with the surface of the ball. The dimples may all be of the same maximum dimension, or different dimension dimples may be provided. Each dimple includes an outer edge 6 having an elongated geometric configuration and a concave bottom surface 8 in the golf ball. The non-circular dimples 4 have a depth extending from the surface of the golf ball to the lowermost portion of the bottom surface.

Figure 3:
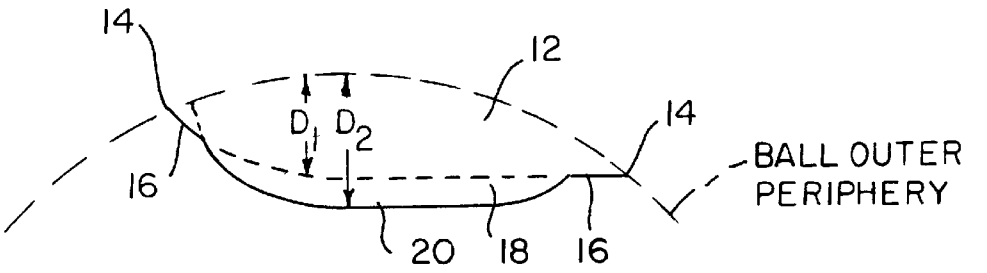
FIG. 3 is a sectional view of the compound dimple of FIG. 2.
Figure 2:
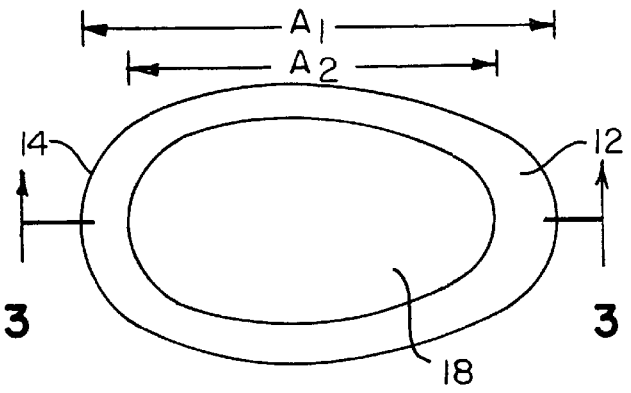
FIG. 2 is a plan view of a compound non-circular dimple according to a first embodiment of the invention.

The golf ball 2 further contains a second plurality or group of compound non-circular dimples 10. As used herein, a compound dimple is essentially a dimple within a dimple. As best shown in FIGS. 2 and 3, a compound dimple includes a first non-circular portion 12 defined by the intersection of the outer edge 14 of the dimple with the golf ball surface. The first portion has a bottom surface 16 and a depth D1 as shown in FIG. 3. In the bottom surface 16 is arranged a second non-circular dimple portion 18 similar to the first dimple portion 12 but having a lesser length and a depth D2 at the bottom surface 20 thereof greater than the depth D1 of the first dimple portion. The length is the distance across the dimple portion between its outer edges along the major axis of the dimple. In the dimple of FIG. 2, the first dimple portion has a length A1 and the second dimple portion has a length A2. Preferably, the second dimple portion 18 is arranged completely within the first dimple portion 12.

As shown in FIG. 2, the configuration of the second dimple portion 18 is similar to that of the first dimple portion 12, with the major axes of each portion being colinear. In addition, as shown in FIG. 3, the bottom surface 16 of the first dimple portion which extends from the deepest portion of the dimple to the surface of the ball is a straight line.

Figure 5:
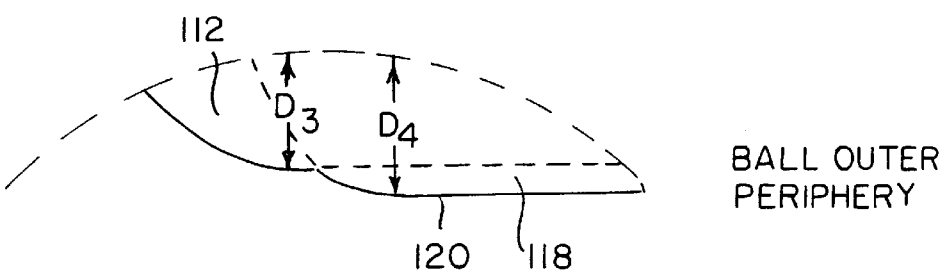
FIG. 5 is a sectional view of the compound dimple of FIG. 4.
Figure 4:
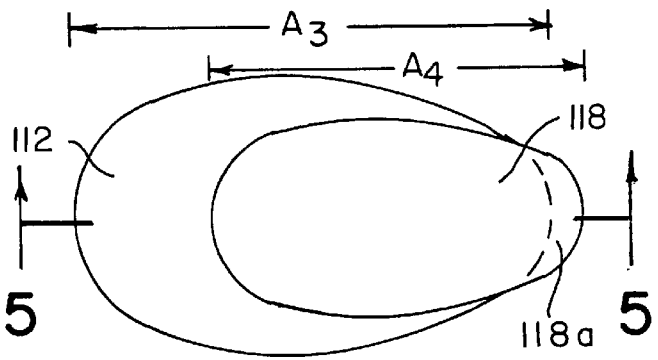
FIG. 4 is a plan view of a compound non-circular dimple according to a second embodiment of the invention.

In the alternate embodiment shown in FIGS. 4 and 5, the first dimple portion 112 has a length A3 and a depth D3 and the second dimple portion 118 has a length A4 less than the length A3 and a depth D4 greater than the depth D3. The first and second dimple portions have similar configurations and colinear major axes. However, as distinguished from the embodiment of FIGS. 2 and 3, the bottom surface 120 of the second dimple portion extends along a straight line from the deepest portion thereof to the ball surface. This results in a section 118*a* of the second dimple portion 118 extending beyond the first dimple portion.

Preferably, the lengths of the non-circular dimples 4 and the compound non-circular dimples 10 are equal, although they need not be. According to the preferred embodiment shown in FIG. 1, there are a greater number of compound dimples 10 than there are non-circular dimples 4. The dimples can be arranged in a geometric pattern on the ball to maximize the dimple coverage on the ball surface. Depending on the geometric pattern, a total of 336, 410, 422 or 428 dimples (both circular and compound) are provided on the ball surface. Other numbers of dimples are possible. Alternatively, the dimples may be randomly arranged on the ball surface.

In another embodiment, a golf ball contains all compound non-circular dimples. They may be of the same or different sizes. In either embodiment, the provision of non-circular compound dimples significantly alters the air flow across the surface of the ball as it travels through the air when struck by a golf club. The altered air flow serves to increase lift and decrease the drag on the ball, thereby increasing the distance that it will travel.

The elongated dimples are manufactured by dragging a milling cutter across a spherical surface. More particularly, as known in the art, a hob is made which has approximately the same dimensions as half of the finished golf ball and then a mold is formed from the hob. The hob has a hemispherical surface which represents the outer surface of a golf ball. A cutting tool is arranged adjacent to the hob and includes a milling cutter having a first radius. When the milling cutter is displaced into the surface along a radius of the hob, it mills a dimple therein. An elongated dimple results when either the hob or the milling cutter is displaced laterally until the milling cutter exits the hob surface. The elongated dimple can be left as is or can be used as the first portion of a compound dimple.

To form a compound dimple, a second milling cutter having a second radius less than the radius of the first milling cutter is milled into the hob, and more particularly into the first dimple portion, to a depth greater than the first milling step. Either the hob or the second cutter is displaced in the same direction in the formation of the first dimple portion. If displacement is terminated before the milling cutter leaves the first dimple portion, a second dimple portion is contained within the first portion as shown in FIGS. 2 and 3. If displacement continues until the second milling cutter leaves the hob surface, a second dimple portion extends partially beyond the first portion as shown in FIGS. 4 and 5.

While the preferred forms and embodiments of the invention have been illustrated and described, it will be apparent to those of ordinary skill in the art that various changes and modifications may be made without deviating from the inventive concepts set forth above.

What is claimed is:

1. A compound dimple for a golf ball, comprising (a) a first non-circular dimple portion having a first depth;

(b) a second non-circular dimple portion at least partially arranged in a surface of said first portion, said second portion having a second depth greater than said first depth, a line along a bottom of one of said first and second non-circular dimple portions between a surface of the golf ball and a deepest point of said respective first and second non-circular dimple portions comprising a straight line.

2. A compound dimple as defined in claim 1, wherein said second portion is completely arranged within said first portion.

3. A compound dimple as defined in claim 1, wherein said second portion has a configuration corresponding to said first portion.

4. A compound dimple as defined in claim 3, wherein said first and second portions have colinear major axes.

5. A compound dimple as defined in claim 4, wherein an axial length of said second portion is less than an axial length of said first portion.

6. A golf ball having a spherical surface containing a plurality of dimples, a first group of dimples comprising compound dimples, each of which includes (a) a first non-circular portion having a first depth; and (b) a second non-circular dimple portion at least partially arranged in a surface of said first portion said second portion having a second depth greater than said first depth, a line along a bottom of one of said first and second non-circular dimple portions between a surface of the golf ball and a deepest point of said respective first and second non-circular dimple portions comprising a straight line.

7. A golf ball as defined in claim 6, wherein said second dimple portion is completely arranged within said first dimple portion.

8. A golf ball as defined in claim 6, wherein said second dimple portion has a configuration corresponding to said first dimple portion.

9. A golf ball as defined in claim 8, wherein said first and second dimple portions have parallel major axes.

10. A golf ball as defined in claim 9, wherein an axis of said second dimple portion is less than an axis of said first dimple portion.

11. A golf ball as defined in claim 6, and further comprising a second group of dimples each of which has a non-circular configuration.

12. A method of forming a compound elongated dimple in a spherical surface, comprising the steps of (a) milling into the surface to a first depth with a first milling cutter having a first radius;

(b) displacing one of the first milling cutter and the surface in a first direction during said milling step to form an elongated first dimple portion;

(c) milling into the first dimple portion to a second depth greater than said first depth with a second milling cutter having a second radius less than said first radius; and (d) displacing one of said surface and said second milling cutter in said first direction during said milling step to form an elongated second dimple portion, said first direction being linear.

13. A method as defined in claim 12, wherein said displacement of said second milling cutter is limited to retain said dimple second portion within said first dimple portion.

14. A method as defined in claim 13, wherein said displacement of said second milling cutter extends to the spherical surface, whereby a portion of said second dimple portion extends beyond said first dimple portion.

* * * * *